US009958209B2

(12) United States Patent
Takahashi

(10) Patent No.: US 9,958,209 B2
(45) Date of Patent: May 1, 2018

(54) PERMANENT MAGNET-TYPE MOLTEN METAL STIRRING DEVICE AND MELTING FURNACE AND CONTINUOUS CASTING APPARATUS INCLUDING THE SAME

(71) Applicant: Kenzo Takahashi, Matsudo (JP)

(72) Inventor: Kenzo Takahashi, Matsudo (JP)

( * ) Notice: Subject to any disclaimer, the term of this patent is extended or adjusted under 35 U.S.C. 154(b) by 107 days.

(21) Appl. No.: 15/113,621

(22) PCT Filed: Jan. 23, 2015

(86) PCT No.: PCT/JP2015/051910

§ 371 (c)(1),
(2) Date: Jul. 22, 2016

(87) PCT Pub. No.: WO2015/111727

PCT Pub. Date: Jul. 30, 2015

(65) Prior Publication Data

US 2017/0003077 A1 Jan. 5, 2017

(30) Foreign Application Priority Data

Jan. 24, 2014 (JP) ..... 2014-011361
Jan. 31, 2014 (JP) ..... 2014-017531

(51) Int. Cl.
*B22D 11/115* (2006.01)
*F27D 27/00* (2010.01)
(Continued)

(52) U.S. Cl.
CPC ..... *F27D 27/00* (2013.01); *B22D 1/00* (2013.01); *B22D 11/04* (2013.01); *B22D 11/041* (2013.01); *B22D 11/115* (2013.01); *F27B 19/02* (2013.01)

(58) Field of Classification Search
CPC ..... B22D 11/04; B22D 11/041; B22D 11/115
See application file for complete search history.

(56) References Cited

U.S. PATENT DOCUMENTS

2006/0001200 A1 1/2006 Takahashi
2006/0133194 A1 6/2006 Takahashi
(Continued)

FOREIGN PATENT DOCUMENTS

CN 87 1 04014 A 12/1988
CN 1715819 A 1/2006
(Continued)

OTHER PUBLICATIONS

Office Action dated Jun. 13, 2017 in Korean Patent Application No. 10-2016-7018828 (with English language translation).
(Continued)

*Primary Examiner* — Kevin P Kerns
*Assistant Examiner* — Steven S Ha
(74) *Attorney, Agent, or Firm* — Oblon, McClelland, Maier & Neustadt, L.L.P.

(57) ABSTRACT

A permanent magnet-type molten metal stirring device includes: a support body that can suppress heat transfer from molten metal; a magnetic field unit provided above the support body and including a permanent magnet allowing magnetic force lines to vertically extend in the molten metal; and a drive unit provided below the support body and driving the molten metal with an electromagnetic force generated by the magnetic force lines and current allowed to flow through the molten metal by the drive unit. The drive unit includes: a cylindrical drive main body mounted on a lower portion of the support body and including a passage formed therein and laterally extending in a longitudinal direction, and a pair of electrodes provided at positions opposed to each other along a width direction via the passage, the pair of electrodes allowing current intersecting the magnetic lines of force in the molten metal.

15 Claims, 13 Drawing Sheets

(51) Int. Cl.

| | |
|---|---|
| ***B22D 1/00*** | (2006.01) |
| ***B22D 11/04*** | (2006.01) |
| ***B22D 11/041*** | (2006.01) |
| ***F27B 19/02*** | (2006.01) |

(56) References Cited

U.S. PATENT DOCUMENTS

| | | | |
|---|---|---|---|
| 2009/0322000 | A1 | 12/2009 | Takahashi |
| 2010/0244338 | A1 | 9/2010 | Takahashi |
| 2012/0104669 | A1 | 5/2012 | Takahashi |
| 2014/0079561 | A1 | 3/2014 | Takahashi |
| 2014/0210145 | A1 | 7/2014 | Takahashi |

FOREIGN PATENT DOCUMENTS

| | | | |
|---|---|---|---|
| CN | 1793765 | A | 6/2006 |
| CN | 201196529 | Y | 2/2009 |
| CN | 101480715 | A | 7/2009 |
| CN | 102990027 | A | 3/2013 |
| CN | 103097554 | A | 5/2013 |
| CN | 103459064 | A | 12/2013 |
| EP | 2 138 790 | A2 | 12/2009 |
| EP | 2 138 790 | A3 | 12/2009 |
| EP | 2 206 998 | A2 | 7/2010 |
| EP | 2 206 998 | A3 | 7/2010 |
| EP | 2 708 839 | A1 | 3/2014 |
| JP | 11-124619 | A | 5/1999 |
| JP | 2006-189229 | A | 7/2006 |
| JP | 4245673 | B2 | 3/2009 |
| JP | 4376771 | B2 | 12/2009 |
| JP | 2011-257129 | A | 12/2011 |
| JP | 2012-137272 | A | 7/2012 |
| JP | 2013-76537 | A | 4/2013 |
| JP | 2014-35131 | A | 2/2014 |

OTHER PUBLICATIONS

Extended European Search Report dated Sep. 27, 2017 in Patent Application No. 15740561.4.

Combined Chinese Office Action and Search Report dated May 15, 2017, in Patent Application No. 201580005165.0 (with English translation and English translation of categories of cited documents).

International Search Report dated Apr. 7, 2015 in PCT/JP2015/051910 filed Jan. 23, 2015.

PERMANENT MAGNET-TYPE MOLTEN METAL STIRRING DEVICE AND MELTING FURNACE AND CONTINUOUS CASTING APPARATUS INCLUDING THE SAME

BACKGROUND OF THE INVENTION

Field of the Invention

The present invention relates to a permanent magnet-type molten metal stirring device that stirs molten metal, such as Al, Cu, Zn, Si, an alloy of at least two of them, a Mg alloy, or other metal (hereinafter, simply referred to as metal or the like), and a melting furnace and a continuous casting apparatus including the permanent magnet-type molten metal stirring device.

Background Art

In the past, an electromagnetic stirring device that stirs molten metal by allowing low-frequency current or high-frequency current to flow in an electromagnetic coil and generating a shifting magnetic field, a mechanical stirring device that directly stirs molten metal while rotary vanes are inserted into the molten metal, and the like have been used to stir molten metal, such as metal or the like (non-ferrous metal or other metal). Main objects of all these devices are to make the composition of molten metal, which is present in a furnace, uniform and to make the temperature distribution of molten metal uniform; and a main object of a melting furnace is to shorten time required to melt a material.

However, in the case of the electromagnetic stirring device using the electromagnetic coil, there are problems in that high power consumption and complicated maintenance are required and initial cost is high. Further, in the case of the mechanical stirring device, there are many problems in that the replacement cost of the rotary vanes per year becomes very high due to the intense use-up of the rotary vanes and a loss caused by downtime is significantly increased since the furnace should be stopped for a long time during the replacement. Furthermore, a system for generating a shifting magnetic field by the rotation of a permanent magnet has also started to be used in recent years, but there is also a problem that the performance of the system deteriorates due to the generation of heat from a furnace reinforcing stainless steel plate.

PRIOR ART

1: Japanese Patent No. 4376771
2: Japanese Patent No. 4245673

SUMMARY OF THE INVENTION

The invention has been made to solve the above-mentioned problems, and an object of the invention is to provide an energy-saving stirring device that reduces the amount of generated heat, is easily subjected to maintenance, is easy to use, has flexibility in an installation object and an installation position, and can also adjust stirring performance; and a melting furnace and a continuous casting apparatus including the stirring device.

A permanent magnet-type molten metal stirring device according to the present invention includes: a support body that is capable of suppressing transfer of heat from molten metal; a magnetic field unit that is provided above the support body and includes a permanent magnet allowing magnetic lines of force to vertically extend in the molten metal; and a drive unit that is provided below the support body and drives the molten metal with an electromagnetic force generated by the magnetic lines of force generated from the permanent magnet and current allowed to flow through the molten metal by the drive unit, wherein the drive unit includes: —a cylindrical drive unit main body that is mounted on a lower portion of the support body and includes a passage formed therein and laterally extending in a longitudinal direction, and —a pair of electrodes that are provided at positions where the pair of electrodes being opposed each other along a width direction via the passage, the pair of electrodes being exposed to the passage, and the pair of electrodes allowing current in the molten metal, the current intersecting the magnetic lines of force.

A melting furnace according to the present invention includes: a main bath and a side well that are partitioned by a hot wall, wherein the hot wall includes an inlet and an outlet that allow the main bath and the side well to communicate with each other, and the permanent magnet-type molten metal stirring device is provided in the side well.

A continuous casting apparatus according to the present invention includes: a mold that cools molten metal to be supplied; and the permanent magnet-type molten metal stirring device that is built in the mold.

DETAILED DESCRIPTION OF THE INVENTION

A permanent magnet-type molten metal stirring device (stirrer) according to an embodiment of the invention will be described below with reference to the drawings. The permanent magnet-type molten metal stirring device is built in various apparatuses while these various apparatuses are not modified just as they are, and can be used to stir molten metal in the various apparatuses. Actually, since the permanent magnet-type molten metal stirring device is used while the permanent magnet-type molten metal stirring device is suspended so that the half of the permanent magnet-type molten metal stirring device is immersed in the molten metal present in the various apparatuses, the installation position and the installation direction of the permanent magnet-type molten metal stirring device relative to the various apparatuses can be freely adjusted. Further, the permanent magnet-type molten metal stirring device can also be adapted so that buoyancy is generated on the permanent magnet-type molten metal stirring device when being immersed in the molten metal. The molten metal stirring device can also be adapted to float in the molten metal by only the buoyancy without being suspended. Furthermore, the molten metal stirring device can also be adapted to float in the molten metal, which is present in the various apparatuses, by a resultant force of the buoyancy and a suspending force. Meanwhile, the scales of the respective drawings to be described below are not the same, and the scale is arbitrarily selected in each drawing.

Figure 1:
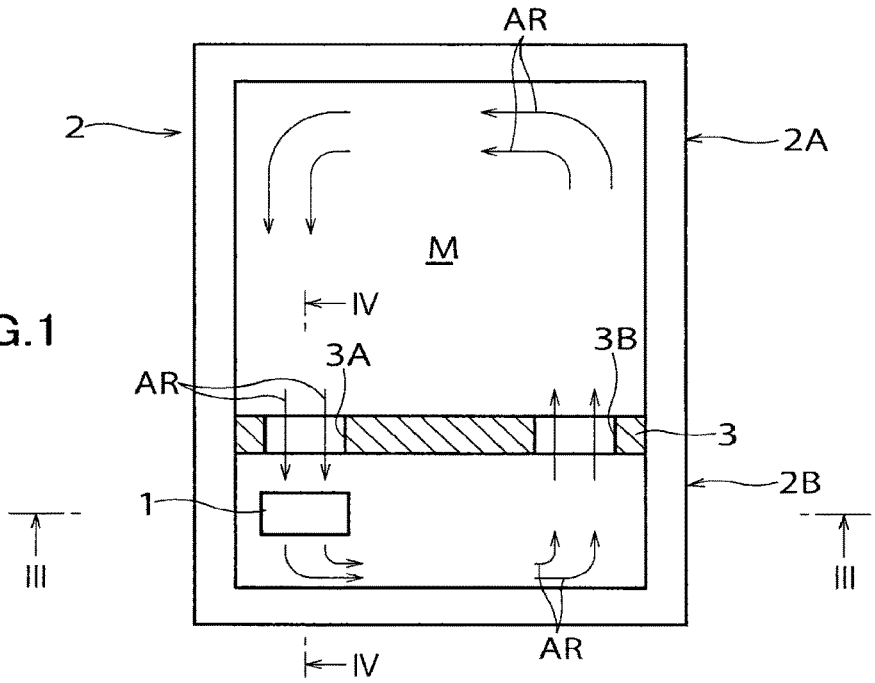
FIG. 1 is a plan view illustrating that a molten metal stirring device according to an embodiment of the invention is built in a melting furnace.

FIG. 1 illustrates an example in which the permanent magnet-type molten metal stirring device 1 of the invention is built in a melting furnace 2 for metal or the like. That is, FIG. 1 is a plan view illustrating that the permanent magnet-type molten metal stirring device 1 according to the embodiment of the invention is suspended so that the half of the permanent magnet-type molten metal stirring device is immersed in molten metal M present in the general-purpose melting furnace 2. That is, as understood from FIGS. 3 and 4, the molten metal stirring device 1 is supported by the suspending force of a wire, only the buoyancy thereof, or a resultant force of the buoyancy thereof and the suspending force of the wire so that the half of the molten metal stirring device 1 is immersed below the surface of the molten metal M.

As understood from FIG. 1, the melting furnace 2 includes a main bath 2A in which a metal material is put and melted and a side well 2B that applies a driving force to the molten metal M. The main bath 2A and the side well 2B are partitioned by a hot wall 3 as a partition plate. An inlet 3A, which allows the molten metal M to flow into the side well 2B from the main bath 2A, and an outlet 3B, which allows the molten metal M to flow out of the side well 2B into the main bath 2A, are opened to the hot wall 3. As particularly understood from FIG. 3, the inlet 3A and the outlet 3B have a so-called arch shape.

Figure 3:
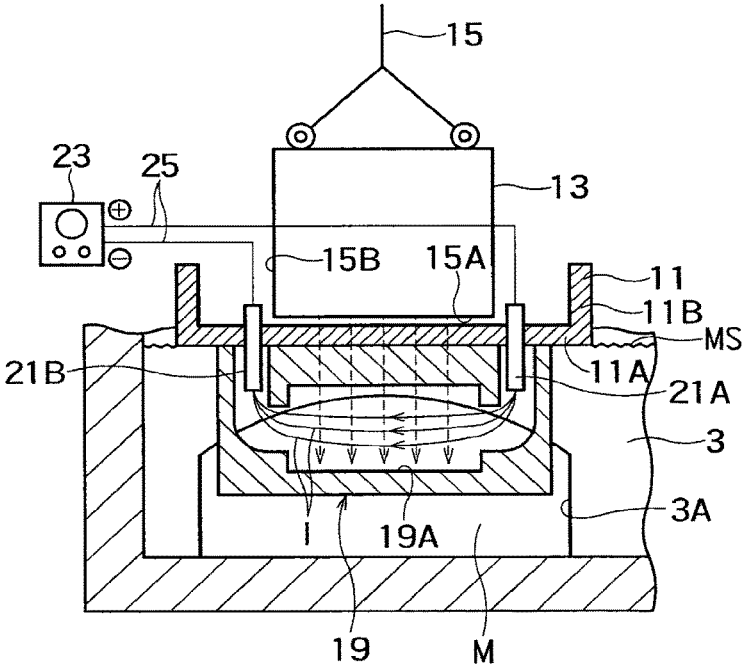
FIG. 3 is a cross-sectional view taken along line III-III of FIG. 1.
Figure 4:
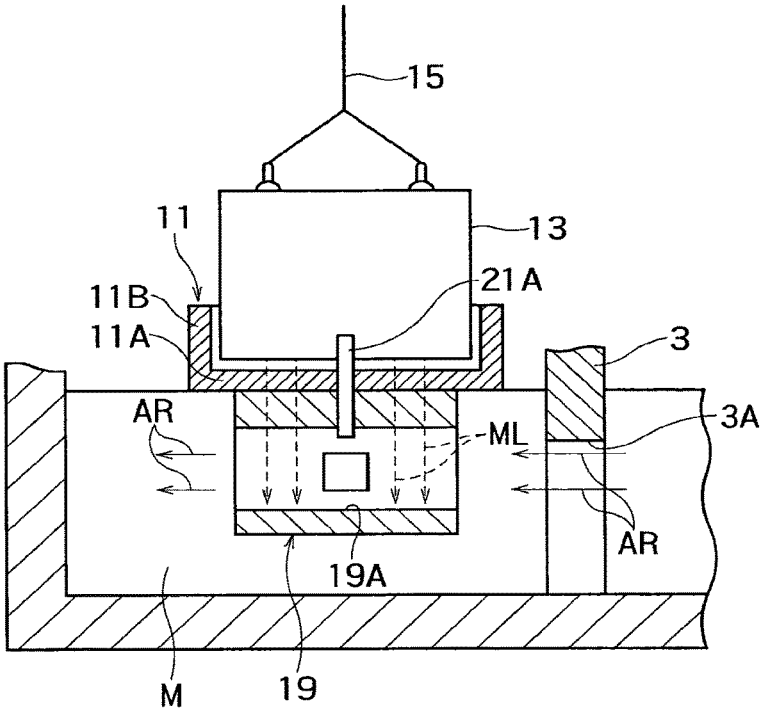
FIG. 4 is a cross-sectional view taken along line IV-IV of FIG. 1.

The details of the state in which the molten metal stirring device (stirrer) 1 is built in the melting furnace 2 are illustrated in FIGS. 3 and 4. That is, FIG. 3 is a cross-sectional view of a part of the molten metal stirring device 1 taken along line III-III of FIG. 1 and FIG. 4 is a cross-sectional view of a part of the molten metal stirring device 1 taken along line IV-IV of FIG. 1.

When the molten metal stirring device 1 is actually set in the melting furnace 2, there are a portion, which is positioned below a molten metal surface MS, and a portion, which is positioned above the molten metal surface MS, of the molten metal stirring device 1 as understood from FIGS. 3 and 4. It is natural that a state in which the molten metal stirring device 1 is immersed in the molten metal is not necessarily limited to the state illustrated in FIGS. 3 and 4.

In more detail, the molten metal stirring device 1 includes a container (support body) 11 that is made of a refractory and insulates and shields heat. That is, the container 11 is adapted to be capable of suppressing the transfer of heat, which is generated from the molten metal, to the permanent magnet 13. The container 11 is formed of a member having substantially the shape of a container of which a storage space 11C is formed by a bottom plate 11A and side plates 11B and the upper surface is opened. The container 11 generates buoyancy corresponding to the specific gravity of the molten metal M. When the molten metal M is, for example, aluminum, the container 11 generates large buoyancy according to the specific gravity of the molten metal M since the specific gravity of aluminum is high.

That is, the container 11 has not only a function of protecting a permanent magnet (magnetic field unit) 13, which will be described below, from the heat of the molten metal (aluminum molten metal or the like) M but also a so-called float function of generating a part or all of buoyancy for allowing the permanent magnet 13 to float on the molten metal M. When the molten metal M is, for example, aluminum as described above, it is also not possible that the container 11 can take the permanent magnet 13 thereon and allows the permanent magnet 13 to float on the molten metal M if the capacity of the container 11 is large since the specific gravity of aluminum is very high.

The permanent magnet 13 is stored in the storage space 11C of the container 11. In this case, the permanent magnet 13 is stored by a mechanism (not illustrated) so that gaps 15A and 15B for cooling are formed between the permanent magnet 13 and the inner surfaces of the container 11, that is, on the bottom portion and side portions of the container 11. That is, as particularly understood from FIGS. 3 and 4, gaps 15A and 15B for air-cooling are formed between the permanent magnet 13 and the bottom plate 11A and the side plates 11B of the container 11. Cooling air can be made to forcibly flow in these gaps 15A and 15B by a blower (not illustrated) or the like.

A suspension wire 15 is mounted on the permanent magnet 13. Since the permanent magnet 13 is suspended through the wire 15 by a crane (not illustrated) or the like, the volume of the container 11 to be immersed in the molten metal M is adjusted. Further, the position and the direction of the molten metal stirring device 1 disposed in the side well 2B can be freely changed as described above by the operation of the crane.

In more detail, for example, as illustrated in FIG. 4, the height of the molten metal stirring device 1, which is suspended according to a relationship between the molten metal stirring device 1 and the molten metal surface MS, that is, the depth of a portion of the molten metal stirring device 1, which is immersed in the molten metal M, needs to be maintained at a predetermined value. For this purpose, a float (not illustrated) is made to float on the molten metal M, the height of the molten metal surface MS is detected while the float is moved up and down together with the molten metal M, and the crane is automatically or manually operated by using a detection value of the height of the molten metal surface MS, so that the molten metal stirring device 1 can be moved up and down. Alternatively, the molten metal surface MS is detected by various switches (not illustrated), such as limit switches, and the molten metal stirring device 1 can also be moved up and down by using the detection value. Further, a cylinder mechanism can also be employed as another mechanism. That is, a piston of a cylinder is moved up and down together with the molten metal surface MS and the height of the molten metal surface MS is detected by the piston, and the molten metal stirring device 1 can also be moved up and down.

A drive unit, which actually drives the molten metal M, is provided below the container 11. The drive unit includes a drive unit main body 19 that is fixed so as to be suspended from the lower surface of the container 11. As particularly understood from FIG. 4, the drive unit main body 19 is formed of a substantially cylindrical member that includes a passage 19A for the molten metal M. In addition, as particularly understood from FIG. 3, a pair of electrodes 21A and 21B are disposed with the passage 19A interposed therebetween. The pair of electrodes 21A and 21B are connected to a power source 23, and a voltage and current are adjusted. Further, the power source 23 may be a power source that can supply not only direct current but also alternating current having a low frequency in the range of, for example, 0 Hz to several tens Hz.

The pair of electrodes 21A and 21B actually penetrate the bottom face 11A of the container 11 in a vertical direction. That is, the pair of electrodes 21A and 21B penetrate the ceiling wall of the drive unit main body 19 and also penetrate the container 11 in a molten metal-tight state, and are provided so as to exposed to the inside of the passage 19A. In other words, only tip portions of the pair of electrodes 21A and 21B come into contact with the molten metal M present in the passage 19A, but base end portions of the pair of electrodes 21A and 21B do not come into contact with the molten metal M since being positioned in the container 11.

In addition, as particularly understood from FIG. 3, the pair of electrodes 21A and 21B are positioned on both sides of the permanent magnet 13 so that the permanent magnet 13 is interposed between the pair of electrodes 21A and 21B in plan view, and vertically penetrate the container 11 at the positions. Wires 25 are connected to the base end portions of the pair of electrodes 21A and 21B. For this reason, the wires 25, which connect the base end portions to the power source 23, do not come into contact with the molten metal M. That is, the number of components, which do not come into contact with the molten metal M, is set to be large in this embodiment to reduce the frequency of maintenance.

According to this structure, as illustrated in FIG. 3, current I flows between the pair of electrodes 21A and 21B through the passage 19A under the presence of the molten metal M. At this time, as understood from FIG. 3, magnetic lines ML of force generated from the permanent magnet 13 extend downward from the upper side in FIG. 3 and intersect the current I. Accordingly, an electromagnetic force according to Fleming's left hand rule is generated and the molten metal M is driven, so that the molten metal M is driven as illustrated by arrows AR of FIG. 4. That is, the molten metal M is extruded to the left as illustrated by left arrows AR of FIG. 4, and is sucked into the side well 2B from the main bath 2A as illustrated by right arrows AR of FIG. 4. Accordingly, the molten metal M is stirred in the main bath 2A and the side well 2B as illustrated by the arrows AR of FIG. 1.

The electrodes 21A and 21B can be made of graphite (carbon), and are so-called consumables. For this reason, the electrodes 21A and 21B need to be replaced after the melting furnace 2 is operated for a certain time. For easy maintenance work, in this embodiment, head portions of the electrodes 21A and 21B protrude into the container 11 and only tips thereof are exposed to the passage 19A of the drive unit main body 19 when the electrodes 21A and 21B are mounted on the container 11. Accordingly, these electrodes 21A and 21B, which have been used up by operation, can be very easily replaced. Meanwhile, it is natural that maintenance work is performed after the permanent magnet-type molten metal stirring device 1 is lifted from the molten metal M.

In FIGS. 3 and 4, a permanent magnet, of which the lower surface side in FIGS. 3 and 4 is magnetized to an N pole and the upper surface side is magnetized to an S pole, is used as the permanent magnet 13. In contrast, it is natural that a permanent magnet, of which the lower surface side is magnetized to an S pole and the upper surface side is magnetized to an N pole, can be used.

Figure 2:
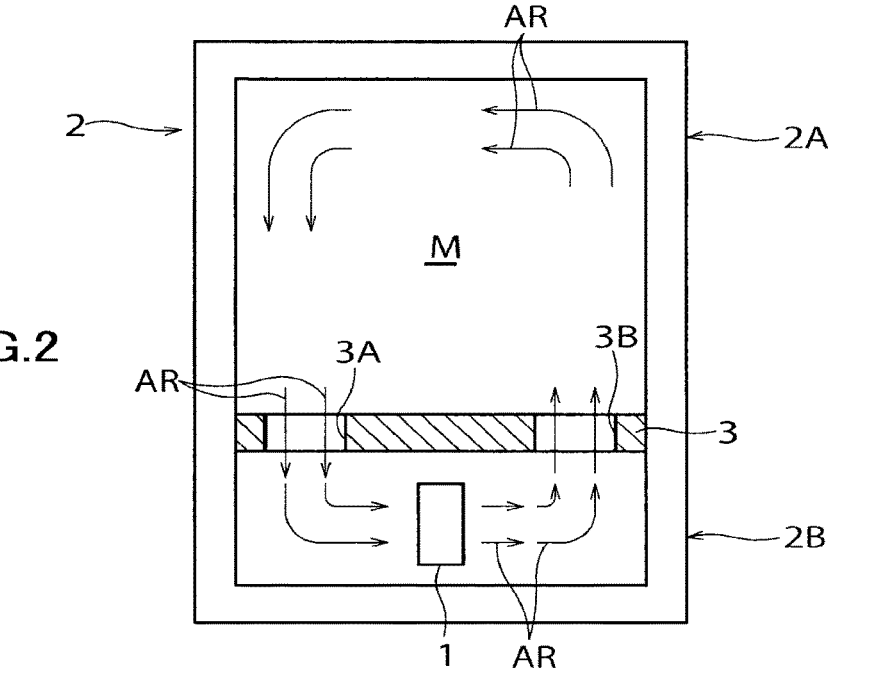
FIG. 2 is a view illustrating a modification of FIG. 1.

FIG. 2 illustrates an example in which the position and the direction of the molten metal stirring device 1 according to the embodiment of the invention built in the side well 2B of the melting furnace 2 are changed. Besides the position and the direction, the molten metal stirring device 1 can also be built in the side well 2B at any position in any direction. It is possible to select a position and a direction where the molten metal M can be more accurately stirred by visual observation or the like.

Further, an example in which only one molten metal stirring device 1 is used is illustrated in FIGS. 1 and 2, but a plurality of molten metal stirring devices 1 can also be arbitrarily used.

Figure 5:
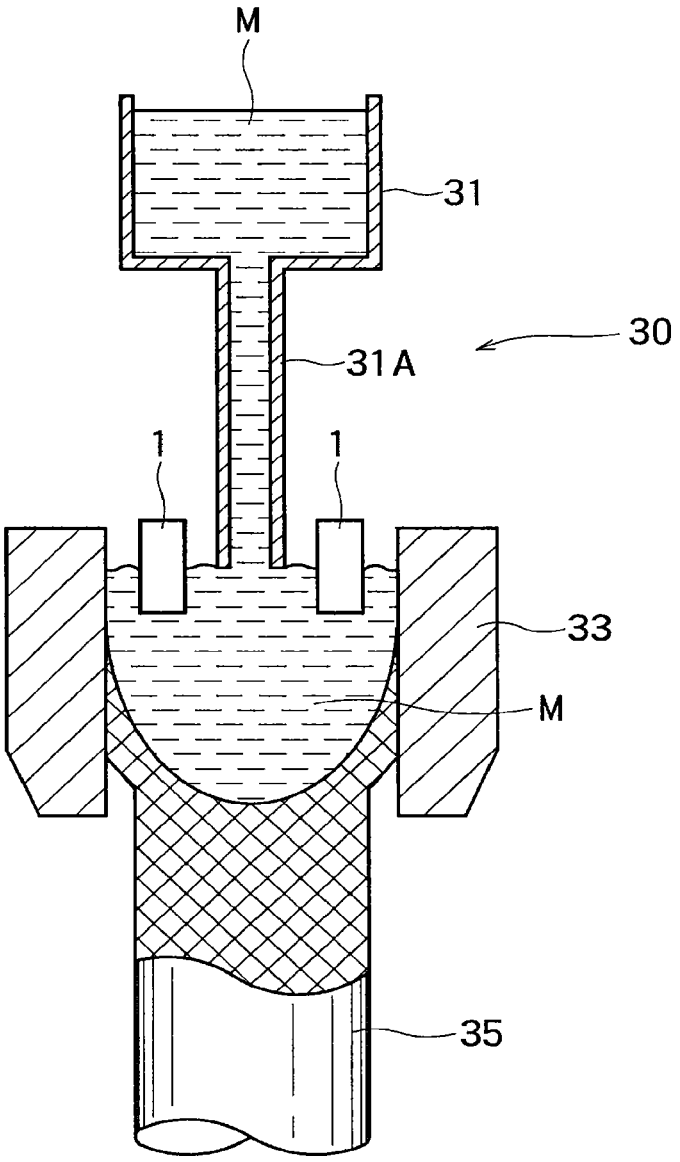
FIG. 5 is a vertical sectional view illustrating that the molten metal stirring device according to the embodiment of the invention is built in a casting apparatus.
Figure 6:
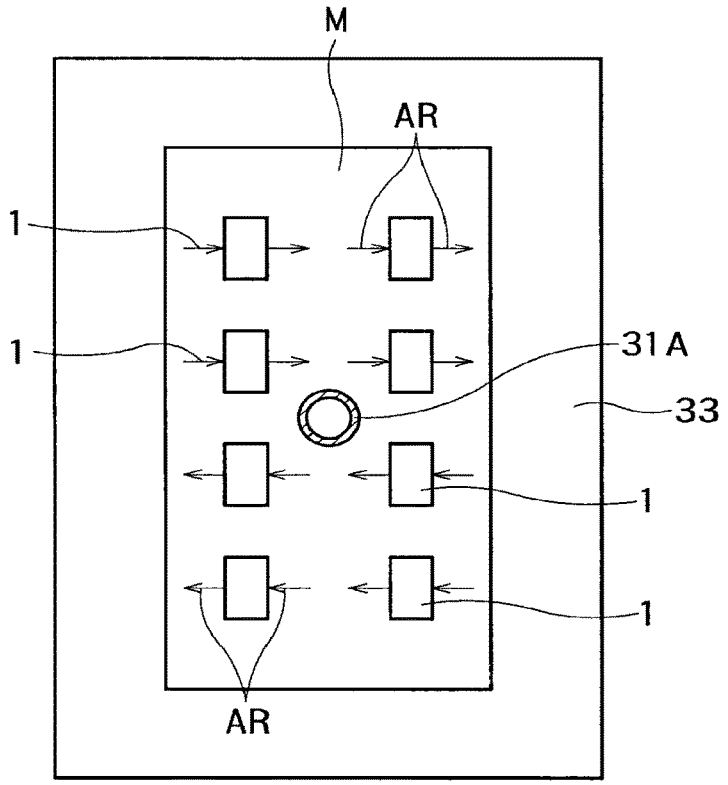
FIG. 6 is a plan view of FIG. 5.
Figure 7:
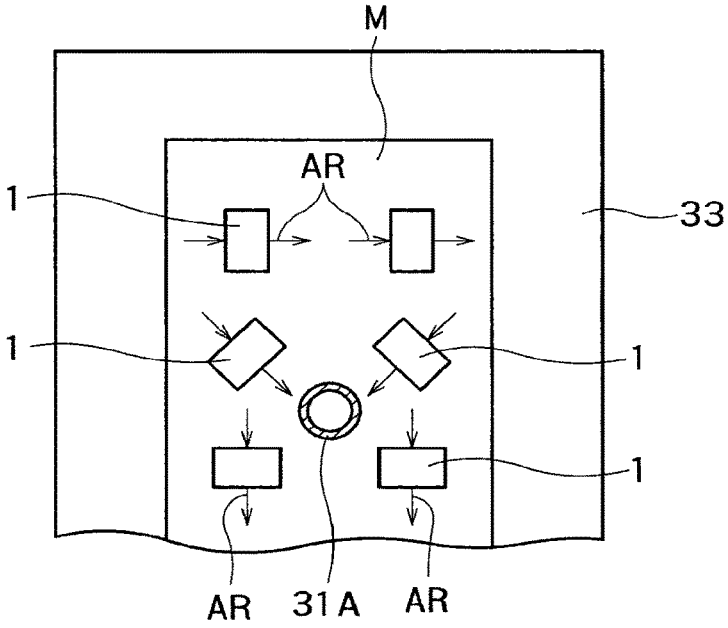
FIG. 7 is a plan view illustrating a part of a modification of FIG. 6.

FIGS. 5 to 7 illustrate examples in which the molten metal stirring devices 1 according to the embodiment of the invention are built in a continuous casting apparatus for producing a product, such as a slab or a billet.

FIG. 5 illustrates an example in which the molten metal stirring devices 1 are built in a general-purpose continuous casting apparatus 30 without the modification of the continuous casting apparatus 30. In brief, the molten metal M is supplied to a mold 33 from a tundish (molten metal receiving box) 31 through a supply pipe 31A. The molten metal M is cooled in the mold 33, so that a product 35 is produced.

A plurality of molten metal stirring devices 1 according to the embodiment of the invention are built so as to be suspended near the surface of the molten metal M that is present in the mold 33 of the continuous casting apparatus 30. FIG. 6 illustrates the planar arrangement and direction of the plurality of molten metal stirring devices 1. Further, FIG. 7 illustrates a case in which the directions of the plurality of molten metal stirring device 1 are changed. The directions of the molten metal stirring devices 1 can be individually adjusted as described above. Furthermore, it is natural that the installation positions and the number of the molten metal stirring devices 1 can be changed. Accordingly, since the molten metal M present in the mold 33 can be accurately stirred, a higher-quality product 35 can be obtained.

FIGS. 8 to 24 are views illustrating other embodiments of the invention. These embodiments are different from the previously described embodiment in terms of the structure of the drive unit main body and the like. That is, for example, the molten metal M is sucked from the right side in FIG. 4 and is horizontally extruded to the left side in the drive unit main body 19 of FIG. 4, but the molten metal M is sucked from the right side and is discharged to the lower side or is discharged in a thickness direction of the plane of the drawings in the following embodiments of the invention. That is, for example, when the embodiments of the invention are used to stir the molten metal M in a continuous casting apparatus for manufacturing a slab as illustrated in FIG. 5, the molten metal M can be stirred at an arbitrary depth or the molten metal M present at an arbitrary position corresponding to an arbitrary depth can be stirred. In other words, when the drive unit main body is adapted to discharge the molten metal M to the lower side and the end of the drive unit main body is formed as an outlet having various shapes, the molten metal M to be stirred can be stirred at a desired arbitrary position (an arbitrary depth and an arbitrary location) as a pin point. This can be said as an advantage that is peculiar to the embodiments of the invention and can never be obtained from the related art. These embodiments will be described in detail below. In the following description, the same components as the previously described components will be denoted by the same reference numerals and the detailed description thereof will be omitted.

Figure 8A:
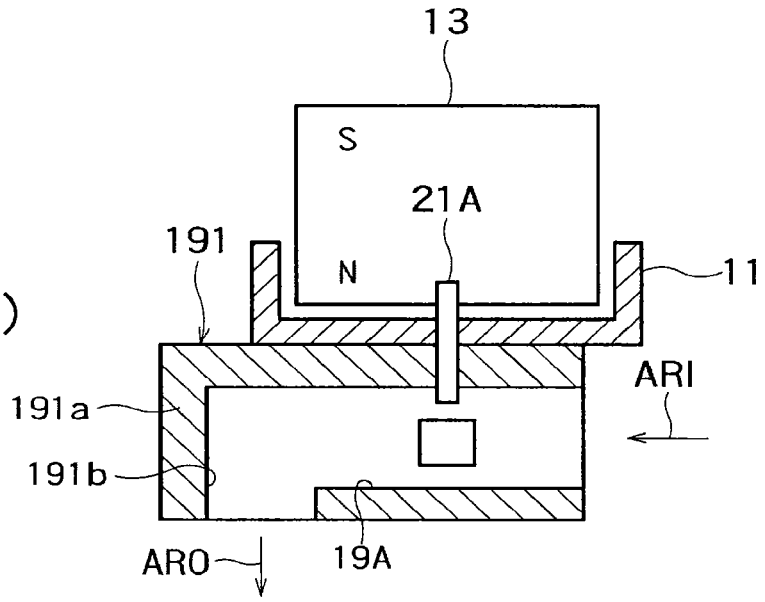
FIG. 8(*a*) is a vertical sectional view of another embodiment of the invention and FIG. 8(*b*) is a plan view thereof.
Figure 8B:
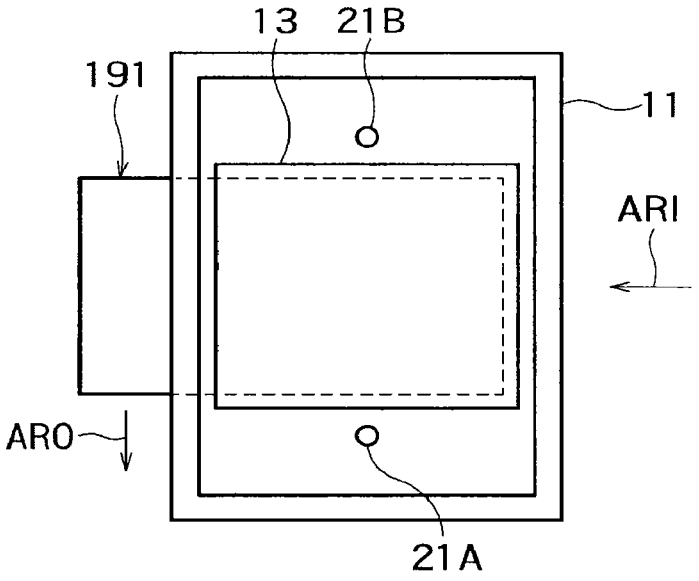

FIGS. 8(*a*) and 8(*b*) illustrate an example in which the molten metal M is discharged to the lower side. That is, FIG. 8(*a*) corresponds to FIG. 4 and is a vertical sectional view, and FIG. 8(*b*) is a plan view. As understood from FIG. 8(*a*), an end of a passage 19A of a drive unit main body 191 is closed by an end wall 191*a*, so that a downward opening 191*b* is formed. Accordingly, the molten metal M is laterally sucked as illustrated by an arrow ARI and is discharged downward as illustrated by an arrow ARO.

Figure 9:
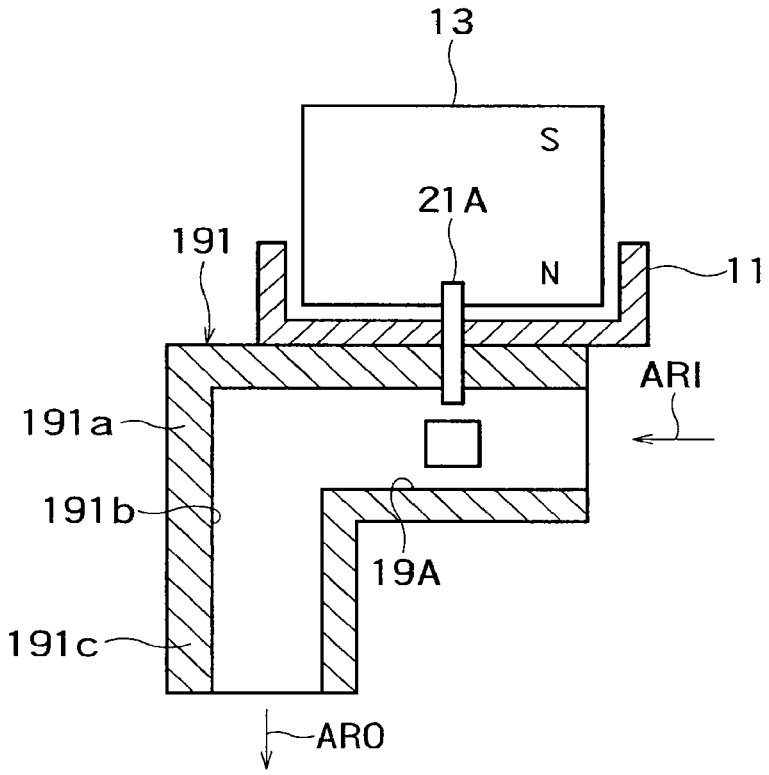
FIG. 9 is a view illustrating a modification of FIG. 8(*a*).

FIG. 9 is a view illustrating a modification of FIGS. 8(*a*) and 8(*b*). Particularly, as understood from the comparison between FIGS. 9 and 8(*a*), the opening 191*b* of the drive unit main body 191 includes a cylinder portion 191*c* that guides the molten metal M downward. The length of the cylinder portion 191*c* can be appropriately set according to a relationship itself and, for example, the depth of the molten metal M of a built mold. Accordingly, for example, a plurality of drive unit main bodies having different lengths are prepared in advance and a drive unit main body 191 including a cylinder portion 191*c* having the most suitable length may be selectively used according to a relationship between the length of the cylinder portion 191*c* and a mold to be applied.

Further, the cylinder portion 191*c* is formed so as to have an extendable joint structure, the length of the cylinder portion is changed according to the use, and the opening of the end of the cylinder portion 191*c* may be made to reach an arbitrary depth position while the position of the cylinder portion is fixed. Various general-purpose structures can be employed as the joint structure.

Furthermore, the shape of the end of the cylinder portion 191*c* can be set to various shapes.

Figure 10:
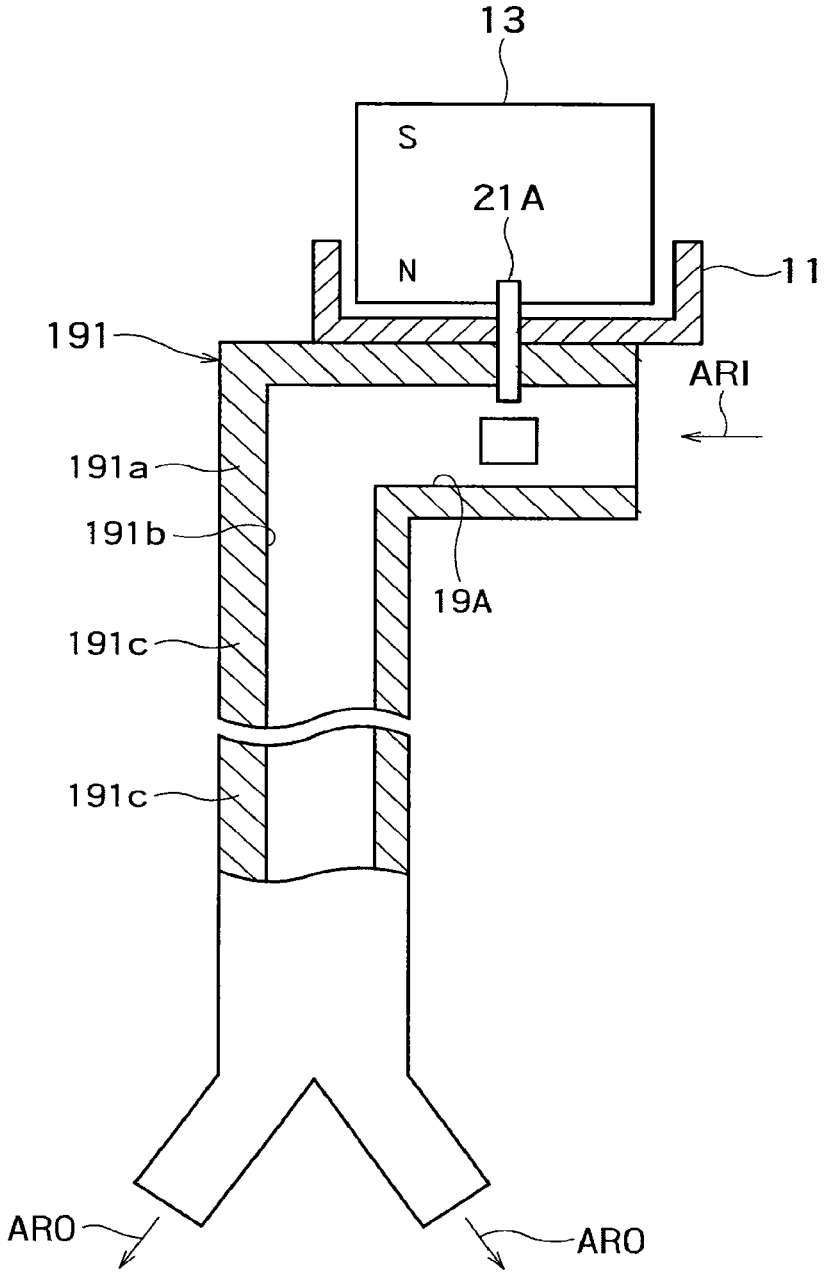
FIG. 10 is a view illustrating a modification of FIG. 9.

FIG. 10 illustrates an example in which the length of a cylinder portion 191*c* is set to be longer than the length of the cylinder portion 191*c* of FIG. 9 and an end of the cylinder portion 191*c* is forked.

Figure 11A:
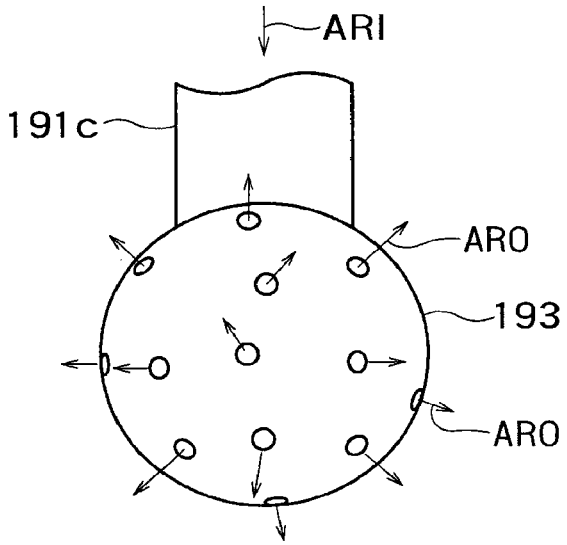
FIGS. 11(*a*), 11(*b*), and 11(*c*) are views illustrating other modifications of FIG. 10.
Figure 11B:
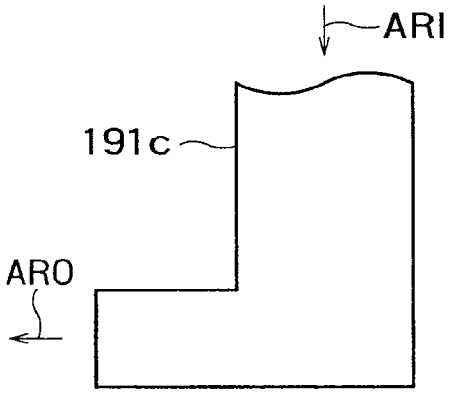
Figure 11C:
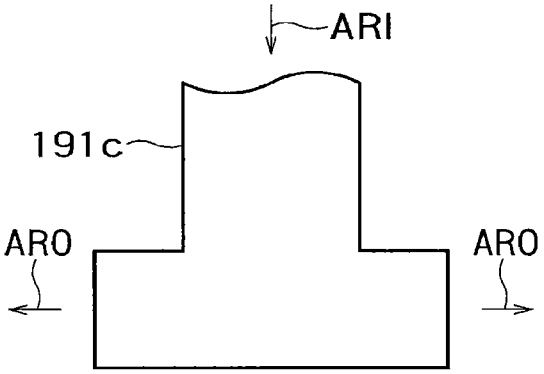

FIGS. 11(*a*), 11(*b*), and 11(*c*) are views illustrating other modifications of FIG. 10, and are front views (elevational views) illustrating only the end portion of FIG. 10.

FIG. 11(*a*) illustrates an example in which a hollow ball-shaped attachment 193 is mounted on the end of the cylinder portion 191*c* and molten metal M is discharged in all directions from holes 193*a* formed at the attachment 193. When FIG. 11(*a*) is applied to, for example, the mold 23 of the continuous casting apparatus, the molten metal M is ejected in all directions of a space at a desired position that is slightly deep in the molten metal M present in the mold 23.

FIG. 11(*b*) illustrates an example in which an end of a cylinder portion 191*c* is bent to the left in FIG. 11(*b*) and is opened. If FIG. 11(*b*) is applied to, for example, the mold 23, the molten metal M is laterally discharged at a desired position that is slightly deep in the mold 23.

FIG. 11(*c*) illustrates an example in which an end of a cylinder portion 191*c* is opened to the left and right in FIG. 11(*c*). If FIG. 11(*c*) is applied to, for example, the mold 23, the molten metal M is discharged to left and right at a desired position that is slightly deep in the mold 23.

Figure 12A:
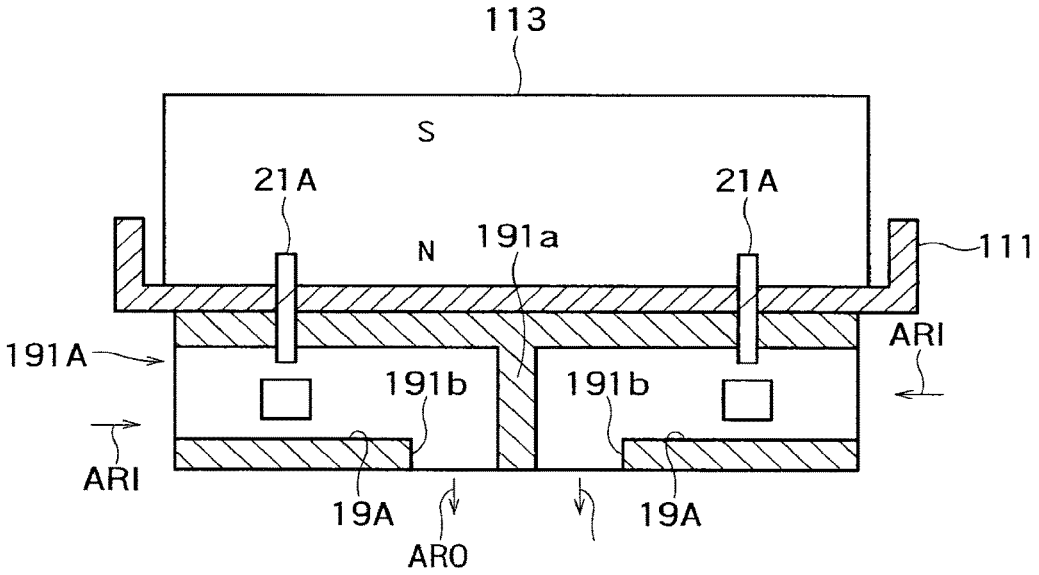
FIG. 12(*a*) is a vertical sectional view of another embodiment of the invention and FIG. 12(*b*) is a plan view thereof.
Figure 12B:
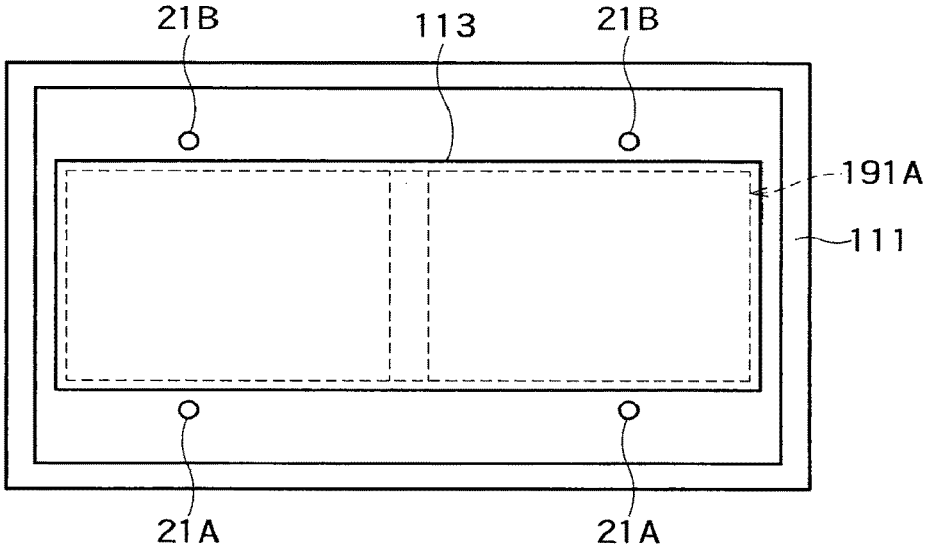

FIG. 12(*a*) illustrates a drive unit main body 191A having a structure in which two drive unit main bodies 191 illustrated in FIG. 8 are integrated with each other so as to include an end wall 191*a* common to the two drive unit main bodies 191. That is, FIG. 12(*a*) illustrates an example in which the molten metal M is horizontally sucked from both left and right sides and is discharged downward as understood from the FIG. 12(*a*). FIG. 12(*b*) is a plan view thereof. From the fact that the direction of the molten metal M to be sucked on the right side is opposite to that on the left side, it is natural that the direction of current flowing in a pair of pair of electrodes 21A and 21B provided on the right side in FIG. 12(*a*) is opposite to the direction of current flowing in a pair of electrodes 21A and 21B provided on the left side in FIG. 12(*a*). Further, in FIGS. 12(*a*) and 12(*b*), a permanent magnet 113 and a container 111 are increased in size as understood from FIG. 12*b*.

Figure 13:
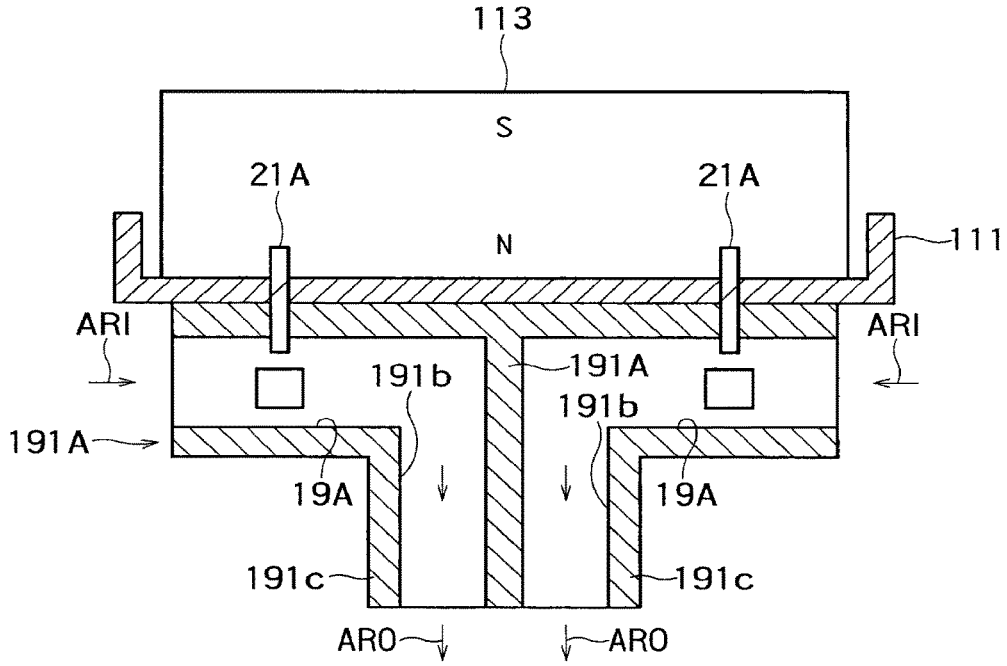
FIG. 13 is a view illustrating a modification of FIG. 12(*a*).

FIG. 13 is a view illustrating a modification of FIG. 12, and employs a structure in which the cylinder portion 191*c* is formed at the opening 191*b* so as to extend. A relationship between FIG. 13 and FIG. 12 is the same as a relationship between FIG. 8 and FIG. 9.

Figure 14:
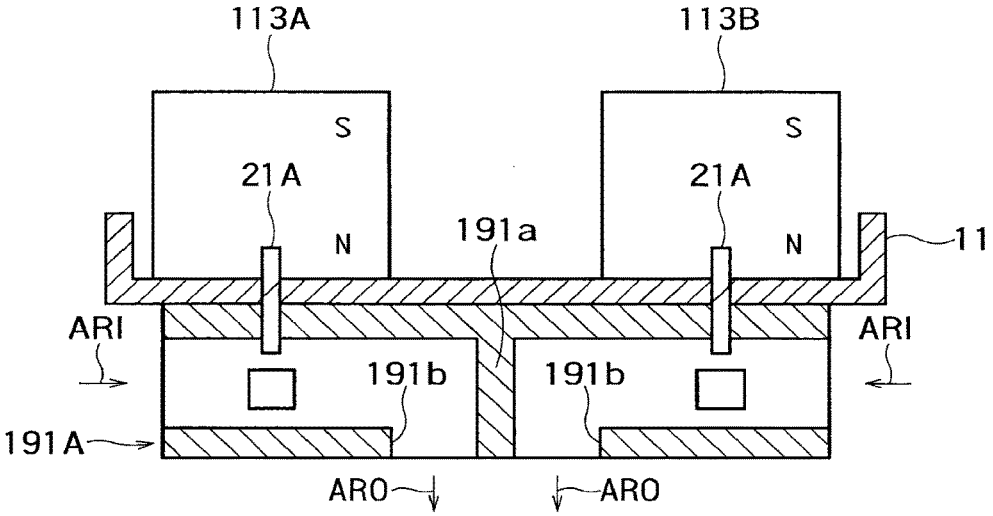
FIG. 14 is a view illustrating a modification of FIG. 12(*a*).

FIG. 14 is a view illustrating a modification of FIG. 13. In FIG. 14, one large permanent magnet 113 of FIG. 13 is substituted with small two permanent magnets 113A and 113B as in FIG. 9 and the like.

Figure 15:
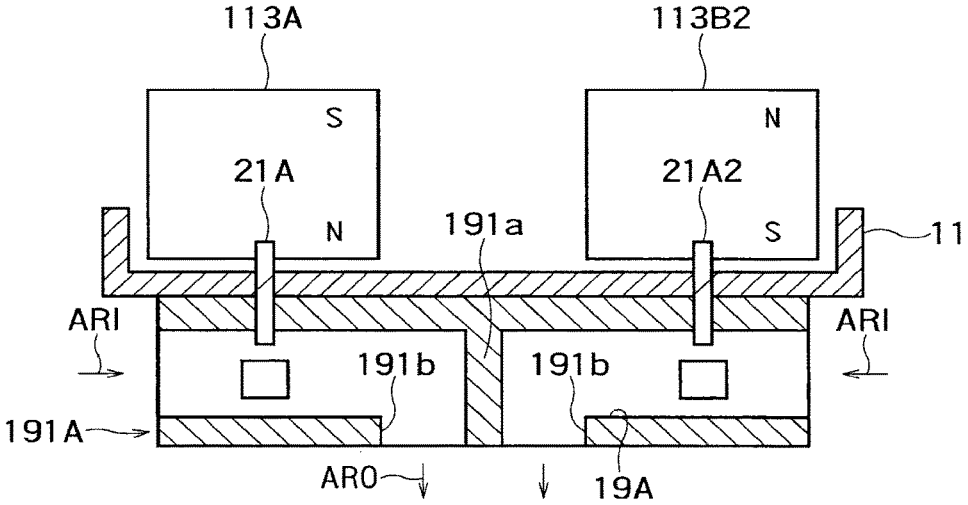
FIG. 15 is a view illustrating a modification of FIG. 14.

FIG. 15 is a view illustrating a modification of FIG. 14. In FIG. 15, the permanent magnet 113B of FIG. 14 is substituted with a permanent magnet 113B2. That is, a lower end of the permanent magnet 113A is magnetized to an N pole, but a lower end of the permanent magnet 113B2 is magnetized to an S pole. In this case, the direction of current I flowing between electrodes 21A and 21B is different from the direction of current I flowing between electrodes 21A2 and 21B2 (21B2 is not illustrated) so that the molten metal M is discharged downward from an opening 191*b* in any case. These electrodes 21A and 21B are connected to the power source 23 of FIG. 3 having been previously described, but the power source 23 is adapted so that the polarity of each output terminal is also changed to a positive polarity from a negative polarity or to a negative polarity from a positive polarity.

Figure 16:
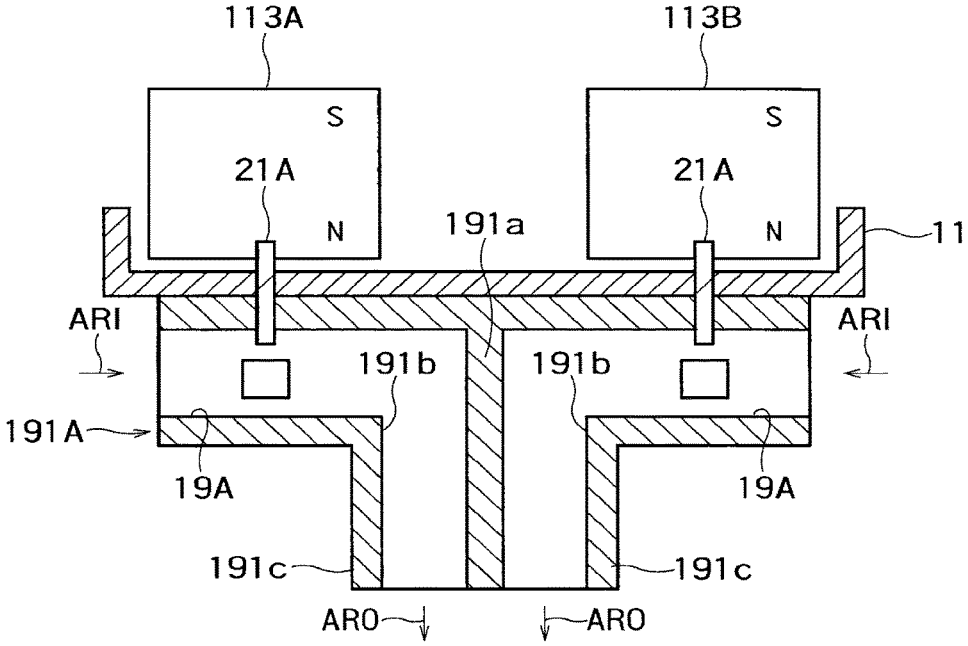
FIG. 16 is a view illustrating a modification of FIG. 13.

FIG. 16 is a view illustrating a modification of FIG. 13, and illustrates an example in which the permanent magnet 113 of FIG. 13 is substituted with two permanent magnets 113A and 113B.

Figure 17:
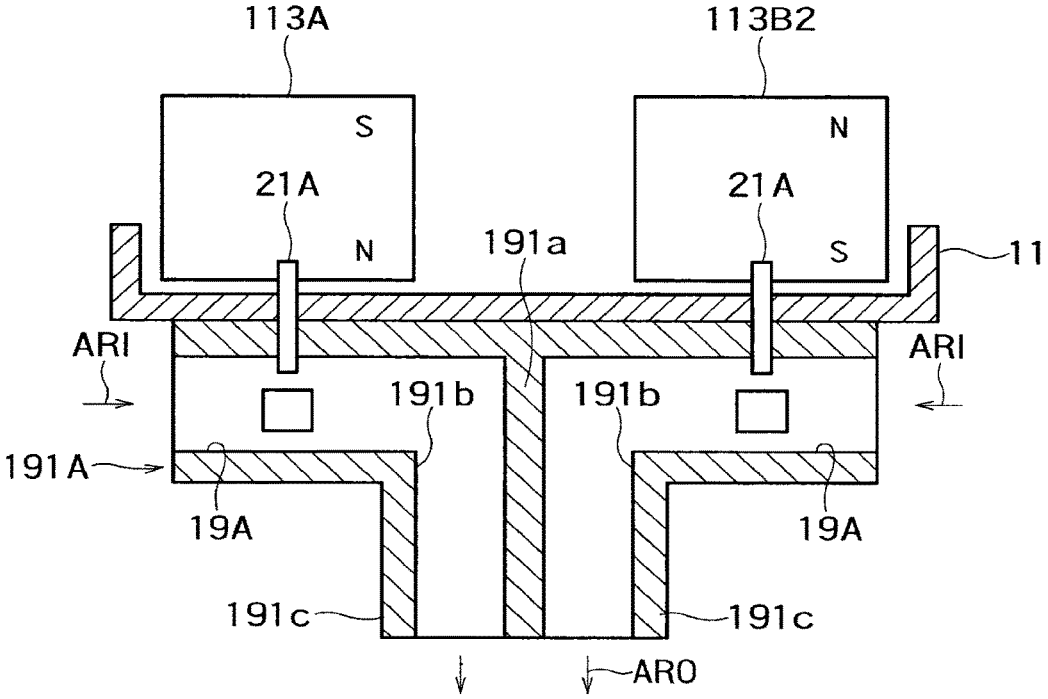
FIG. 17 is a view illustrating a modification of FIG. 16.

FIG. 17 is a view illustrating a modification of FIG. 16, and illustrates an example in which a permanent magnet 113B2 is formed by the change of the direction of the magnetization of the permanent magnet 113B of FIG. 16.

Figure 18A:
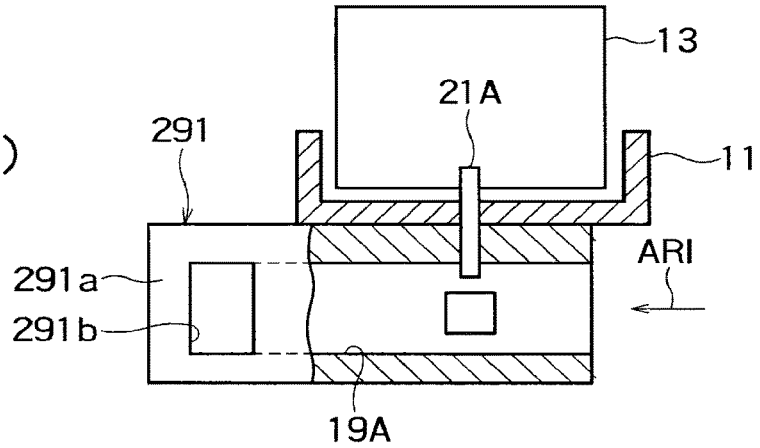
FIGS. 18(*a*) to 18(*c*) illustrate a vertical sectional view and a plan view of still another embodiment of the invention and a cross-sectional view of a drive unit main body.
Figure 18B:
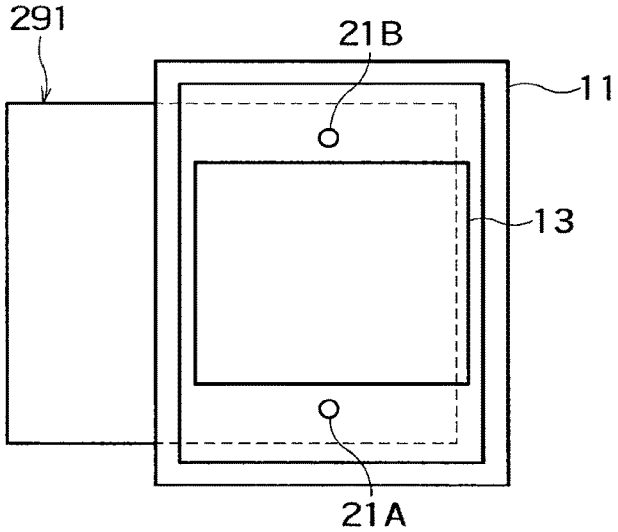
Figure 18C:
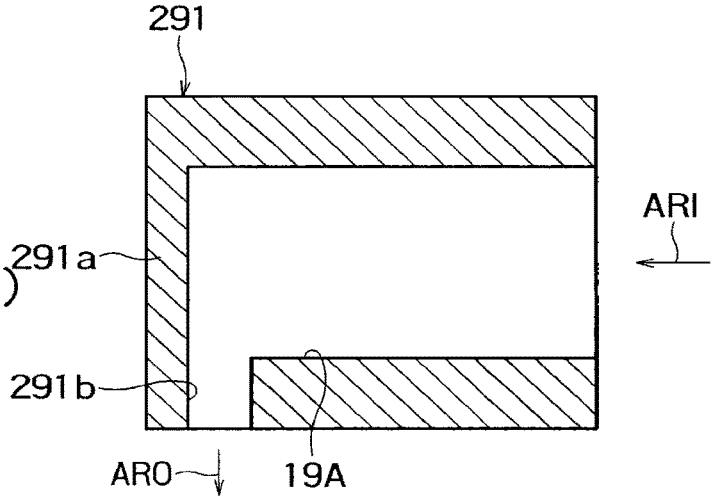

FIGS. 18(*a*), 18(*b*), and 18(*c*) illustrate an example in which laterally sucked molten metal M is discharged in a lateral direction orthogonal to the suction direction of the molten metal M. FIG. 18(*a*) is a vertical sectional view, FIG. 18(*b*) is a plan view, and FIG. 18(*c*) is a cross-sectional view of a drive unit main body 219. Particularly, as understood from FIG. 18(*c*) illustrating a cross-section, an end of a passage 19A of the drive unit main body 291 is closed by an end wall 291*a*, so that a lateral opening 291*b* is formed.

Various embodiments have been described above with reference to the drawings, but embodiments other than the illustrated embodiments can also be employed. That is, an embodiment in which various embodiments having been described above are appropriately combined can also be employed.

When a product is generally produced by a continuous casting apparatus, according to at least knowledge of the inventor, it is very important to thoroughly stir the molten metal M if possible. However, in the case of the manufacture of a slab, a large value is employed as each of the diameter and the depth of a mold and the amount of molten metal M is large. For this reason, it is very difficult to accurately stir the mold. However, when the above-mentioned device according to the embodiment of the invention is used, it is possible to accurately stir the molten metal M at the time of the manufacture of not only a billet but also a slab. Accordingly, it is possible to obtain a high-quality product.

According to the above-mentioned embodiments of the invention, the following various advantages peculiar to the embodiments of the invention are obtained.

Since a magnetic field is applied from the surface of the molten metal M in a depth direction as a magnetic field that is required to obtain an electromagnetic force for driving the molten metal M, the magnetic field is effectively applied to the molten metal M even though the depth of the molten metal M is reduced. Accordingly, an electromagnetic force can be accurately obtained. That is, a magnetic field is applied downward from the top in a vertical direction. Therefore, even though the amount (the height of the molten metal surface MS) of the molten metal M present in the main bath 2A, that is, the side well 2B is changed, the molten metal stirring device 1 has only to be moved up and down according to the amount of molten metal M. Accordingly, since a magnetic field is accurately applied to the molten metal M regardless of the amount of molten metal M and an electromagnetic force is generated, the molten metal M can be reliably driven on the side of the side well 2B.

For this reason, constant capability for driving the molten metal M can be obtained regardless of the amount (height) of the molten metal M. According to inventor's experiments, capability in the range of 1200 ton/hour to 2200 ton/hour could be obtained.

The melting furnace 2 or the casting apparatus do not need to be modified. That is, since the molten metal stirring device 1 according to the embodiment of the invention is used while being partially immersed in the molten metal M stored in the melting furnace 2 or the like as the other part in which the molten metal stirring device 1 is to be built, the melting furnace 2 or the like does not need to be modified. For example, holes do not need to be formed in the wall of the melting furnace 2. Further, the molten metal stirring device 1 can be built regardless of the thickness of the wall of the device as the other part, for example, the melting furnace 2. In the past, there has also been a case in which it is considered that the wall should be made thin in order to accurately apply a magnetic field to the molten metal M. However, since the wall could not be made thin, there has also been a case in which the molten metal stirring device 1 cannot be built in actuality. However, according to the invention, there is no concern that the molten metal stirring device 1 cannot be built. Furthermore, an increase in the size of the entire system is avoided and the structure of the system is also simplified.

The replacement and maintenance of the electrodes 21A and 21B are easily performed.

The molten metal stirring device 1 can be installed at any position in the side well 2B.

Since the molten metal stirring device 1 is installed so as to be suspended into the side well 2B of the melting furnace 2, the replacement and maintenance of the drive unit main body 19 are very easy when the molten metal stirring device 1 is detached from the melting furnace 2.

Since the wires 25, which connect the pair of electrodes 21A and 21B to the power source 23, do not come into contact with the molten metal M, the necessity of maintenance can be reduced.

Since a magnetic field is applied to the molten metal M without passing through the thin wall of the melting furnace 2 or the like, a small permanent magnet can also be used as the permanent magnet 13. Further, if a permanent magnet 13 having the same performance as in the related art is used, a larger electromagnetic force can be obtained. For example, if the permanent magnet 13 having the same performance as in the related art is used, it is possible to obtain an electromagnetic force having a magnitude 1.5 to 2.0 times the magnitude of an electromagnetic force that is obtained when a magnetic field is applied to the molten metal through the wall, since a magnetic field does not pass through the wall or the like. Furthermore, in terms of power consumption, power consumption can also be significantly suppressed to, for example, the range of 1/10 to 1/20 if a permanent magnet 13 having the same performance is used. Accordingly, it is possible to obtain a very energy-saving device.

In terms of magnetic field strength, there is a wide choice of the material of the drive unit main body 19 since only the container 11 is interposed between the permanent magnet 13 and the molten metal M. Accordingly, the material and strength of the drive unit main body 19 can also be freely selected.

Since the molten metal M is driven near the surface thereof when the molten metal stirring device 1 of the invention is used, a state in which the molten metal M is driven can be visually observed from the outside. Accordingly, it is possible to more appropriately stir and drive the molten metal M by adjusting the length of a portion, which is immersed in the molten metal M, of the molten metal stirring device 1 through visual observation or adjusting the amount of current I to flow.

Generally, the main bath 2A is provided with a lid for the purpose of heat insulation, but there are many side wells 2B that are not provided with lids. For this reason, the molten metal stirring device 1 of the invention, which shields the permanent magnet 13 from the heat of the molten metal M by the container 11 for insulating heat, is suitably used while being built in the side well 2B that is not provided with a lid.

The molten metal, which is present in a container and is to be stirred, can be stirred at an arbitrary depth and an arbitrary location as a pin point.

The invention claimed is:

1. A permanent magnet molten metal stirring device comprising:

a support body that is capable of suppressing transfer of heat from molten metal;

a magnetic field unit that is provided above the support body and includes a permanent magnet allowing magnetic lines of force to vertically extend in the molten metal; and a drive unit that is provided below the support body and drives the molten metal with an electromagnetic force generated by the magnetic lines of force generated from the permanent magnet and current allowed to flow through the molten metal by the drive unit, wherein the drive unit includes:

a cylindrical drive unit main body that is mounted on a lower portion of the support body and includes a passage formed therein and laterally extending in a longitudinal direction, and a pair of electrodes that are provided at positions where the pair of electrodes being opposed to each other along a width direction via the passage, the pair of electrodes being exposed to the passage, and the pair of electrodes allowing current in the molten metal, the current intersecting the magnetic lines of force.

2. The permanent magnet molten metal stirring device according to claim 1, wherein the support body is formed of a container member that includes a storage space formed therein by a bottom wall and side walls, and base end portions of the pair of electrodes penetrate a ceiling wall of the chive unit main body and a bottom wall of the support body and are positioned in the storage space of the support body.

3. The permanent magnet molten metal stirring device according to claim 1, wherein the permanent magnet is provided at a position, where the permanent magnet allows the magnetic lines of force to vertically extend in the passage, above the drive unit main body.

4. The permanent magnet molten metal stirring device according to claim 1, wherein the pair of electrodes are provided at positions where the pair of electrodes being opposed to each other along a width direction via the passage to allow current to laterally flow.

5. The permanent magnet molten metal stirring device according to claim 1, wherein the pair of electrodes are connected to a power source, which allows direct current or alternating current to flow in the pair of electrodes, through wires that extend above the support body.

6. The permanent magnet molten metal stirring device according to claim 1, further comprising:

a suspension mechanism that integrally suspends the support body, the magnetic field unit, and the drive unit and is capable of adjusting suspension heights of the support body, the magnetic field unit, and the drive unit.

7. The permanent magnet molten metal stirring device according to claim 6, further comprising:

a detector that detects a height of a surface of the molten metal, wherein the suspension mechanism is driven on the basis of a detection value detected by the detector.

8. The permanent magnet molten metal stirring device according to claim 1, wherein a gap, which is used to cool the permanent magnet, is formed between the support body and the permanent magnet.

9. The permanent magnet molten metal stirring device according to claim 1, wherein one end of the passage of the drive unit main body forms a first opening for suction and the other end of the passage forms a second opening for discharge, the first opening is opened along a straight line laterally extending, and the second opening is opened along a straight line vertically extending.

10. The permanent magnet molten metal stirring device according to claim 9, wherein a cylinder portion, which vertically extends, is formed at the second opening of the passage, the passage communicates with the outside through an opening of a lower end of the cylinder portion.

11. The permanent magnet molten metal stirring device according to claim 10, wherein the opening of the lower end of the cylinder portion is opened downward, is opened laterally, or is opened and branched into a plurality of openings.

12. The permanent magnet molten metal stirring device according to claim 1, wherein the drive unit main body includes a plurality of passages, and includes the pair of electrodes in each of the plurality of passages.

13. The permanent magnet molten metal stirring device according to claim 1, wherein one end of the passage of the drive unit main body forms a first opening for suction and the other end of the passage forms a second opening for discharge, the first opening and the second opening are opened together along a straight line laterally extending, or the first opening is opened along one straight line and the second opening is opened along an other straight line, the one and the other straight lines intersecting each other.

14. A melting furnace comprising:

a main bath and a side well that are partitioned by a hot wall, wherein the hot wall includes an inlet and an outlet that allow the main bath and the side well to communicate with each other, and the permanent magnet molten metal stirring device according to claim 1 is provided in the side well.

15. A continuous casting apparatus comprising:

a mold that cools molten metal to be supplied; and the permanent magnet molten metal stirring device according to claim 1 that is built in the mold.

* * * * *